US006113525A

United States Patent [19]

Waechter

[11] Patent Number: 6,113,525

[45] Date of Patent: Sep. 5, 2000

[54] METHOD OF AND APPARATUS FOR FOLDING FLAPS ON BLANKS OF PACKETS FOR ROD-SHAPED SMOKERS' PRODUCTS

[75] Inventor: Michael Kleine Waechter, Juliusburg, Germany

[73] Assignee: Topack Verpackungstechnik GmbH, Schwarzenbek, Germany

[21] Appl. No.: 09/080,202

[22] Filed: May 18, 1998

[30] Foreign Application Priority Data

May 16, 1997 [DE] Germany ..... 197 20 500

[51] Int. Cl.[7] ..... B31B 1/50

[52] U.S. Cl. ..... 493/183; 493/162; 493/177; 493/447; 493/449; 493/453; 493/454; 493/911

[58] Field of Search ..... 493/911, 910, 493/183, 453, 449, 447, 446, 180, 182, 454, 457, 177, 162

[56] References Cited

U.S. PATENT DOCUMENTS

| | | | |
|---|---|---|---|
| 3,956,865 | 5/1976 | Schmermund | 493/911 |
| 4,084,393 | 4/1978 | Focke | 493/911 |
| 4,188,024 | 2/1980 | Seragnoli | 493/457 |
| 4,392,338 | 7/1983 | Fox | 493/911 |
| 4,487,596 | 12/1984 | Livens et al. | 493/911 |
| 4,852,734 | 8/1989 | Allen et al. | 229/160.1 |
| 5,143,282 | 9/1992 | Pham | 229/160.1 |

FOREIGN PATENT DOCUMENTS

| | | |
|---|---|---|
| 28463386C2 | 3/1974 | Germany . |
| 2718953 | 11/1977 | Germany . |
| 8715474U1 | 3/1988 | Germany . |
| 1467429 | 3/1977 | United Kingdom . |
| 2091162A | 7/1982 | United Kingdom . |
| 2123796A | 2/1984 | United Kingdom . |

*Primary Examiner*—Brian L. Johnson
*Assistant Examiner*—Matthew Luby
*Attorney, Agent, or Firm*—Venable; George H. Spencer; Robert Kinberg

[57] ABSTRACT

The cardboard blanks for conversion into hinged-lid packets for arrays of cigarettes are dimensioned and configurated in such a way that an elongated reinforcing strip at the inner side of the front panel of the lid is longer than the front panel. Those terminal sections of the reinforcing strip which extend beyond the ends of the front panel in a blank are bent prior to or during the folding of the reinforcing strip against the inner side of the front panel so that they do not adversely affect the configuration of the lateral panels of the lid and the appearance of a finished packet because the lateral panels are not caused to bulge outwardly.

24 Claims, 4 Drawing Sheets

METHOD OF AND APPARATUS FOR FOLDING FLAPS ON BLANKS OF PACKETS FOR ROD-SHAPED SMOKERS' PRODUCTS

BACKGROUND OF THE INVENTION

The invention relates to improvements in so-called hinged-lid packets for arrays of rod-shaped articles of the tobacco processing industry. More particularly, the invention relates to improvements in methods of and in apparatus for making the lids of such packets. Still more particularly, the invention relates to improvements in methods of and in apparatus for making hinged-lid packets of the type wherein the front panel of the lid is reinforced by an elongated strip which overlies the inner side of and, prior to conversion of a blank into a hinged-lid packet, is longer than the front panel.

Blanks for conversion into hinged-lid packets for arrays of parallel cigarettes or other rod-shaped smokers' products are normally made of lightweight cardboard. Such blanks are provided with fold lines so that they can be readily and accurately (predictably) draped around parallelepiped (block-shaped) contents normally consisting of arrays of say twenty parallel plain or filter cigarettes in an envelope of tinfoil or other suitable wrapping material. The lid of a finished hinged-lid packet is pivotable relative to the rear wall of the main portion of the packet so that it can afford access to or can repeatedly confine the contents of the packet. The front panel of the lid is normally reinforced by a longitudinally extending strip which overlies the inner side of the front panel adjacent the free edge of the latter. Such free edge is adjacent the front wall of the major portion of the packet when the lid assumes its closed or confining position.

The reinforcing strip can be bonded to the inner side of the front panel of the lid, or it can be mechanically clamped or wedged between the lateral panels of the lid. In the latter case, that (first) part of a blank which is to constitute the reinforcing strip in a converted blank (i.e., in a finished hinged-lid packet) is somewhat longer than the neighboring (second) part of the blank which is to constitute the front panel of the lid. Those (terminal) sections of the first part which extend beyond the adjacent end portions of the second part are deformed during conversion of the blank into a hinged-lid packet so that they are wedged between and bear against the adjacent lateral panels of the finished lid, i.e., it is not necessary to glue or to otherwise bond or positively secure the reinforcing strip to the front panel of the lid. Reference may be had, for example, to published German patent application No. 32 18 639 A1 which describes and shows hinged-lid packets wherein the reinforcing strip for the front panel of the lid is longer than the front panel and is not bonded to the front panel but is merely wedged or confined between the lateral panels of the lid.

U.S. Pat. No. 4,154,438 (granted May 15, 1979 to Sergnoli for "HIGH SPEED CONVEYOR FOR FEEDING PRESHAPED PIECES OF CARDBOARD") discloses an apparatus for transporting or advancing a series of successive cardboard blanks which are to be converted into hinged-lid packets for arrays of cigarettes in a cigarette packing machine. The blanks which are to be transported in the apparatus of Seragnoli also include parts which are to constitute reinforcing strips for the front panels of the lids of hinged-lid packets; however, such parts are not longer than the front panels, i.e., the reinforcing strips must be bonded to the inner sides of the front panels.

The disclosures of all patents and patent applications which are mentioned in the present specification are incorporated herein by reference.

A drawback of presently known hinged-lid packets wherein the reinforcing strip is longer than the front panel of the lid and the terminal sections of such strip bear against the lateral panels of the lid is that the terminal sections effect a deformation of the lateral panels; this exerts an adverse influence upon the appearance of such hinged-lid packets.

OBJECTS OF THE INVENTION

An object of the invention is to provide a novel and improved method of making hinged-lid packets of the type wherein the reinforcing strips for the front panels of the lids of such packets are longer than the front panels.

Another object of the invention is to provide a method which ensures that the terminal sections of the reinforcing strips (which are longer than the front panels) cannot unduly (such as visibly) deform the lateral panels of the lids.

A further object of the invention is to provide a method which renders it possible to reliably maintain the reinforcing strip (which is longer than the front panel) in an optimum position without bonding the reinforcing strip to the front panel and without adversely affecting the strength and/or the appearance of the lid.

An additional object of the invention is to provide a hinged-lid packet which is obtained in accordance with the above outlined method.

Still another object of the invention is to provide a novel and improved blank (such as a cardboard blank) which can be converted into a hinged-lid packet of the above outlined character.

A further object of the invention is to provide a novel and improved apparatus for the practice of the above outlined method.

Another object of the invention is to provide a relatively simple, compact and inexpensive apparatus which can convert blanks (such as lightweight cardboard blanks) into hinged-lid packets for arrays of rod-shaped articles of the tobacco processing industry at a high frequency and with a high degree of reproducibility.

An additional object of the invention is to provide the above outlined apparatus with novel and improved means for manipulating those parts of the blanks for conversion into hinged-lid packets which are to constitute the front panels and reinforcing strips for front panels of the lids forming part of hinged-lid packets of the type wherein the terminal sections of the reinforcing strip must be deformed in order to be properly confined in the lid.

Still another object of the invention is to provide a cigarette packing machine which embodies or cooperates with an apparatus of the above outlined character.

A further object of the invention is to provide a production line which embodies one or more apparatus of the above outlined character.

Another object of the invention is to provide a novel aid improved hinged-lid packet which is obtained by resorting to an apparatus of the above outlined character.

An additional object of the invention is to provide a hinged-lid packet which embodies a novel and improved hinged lid and which can be utilized with particular advantage as a superior substitute for heretofore known packets serving to confine groups or arrays of rod-shaped articles of the tobacco processing industry.

SUMMARY OF THE INVENTION

One feature of the present invention resides in the provision of a method of manipulating a first elongated plate-like part which constitutes a first component of a blank to be converted into a hinged-lid packet for rod-shaped smokers' products, which has a first length and two spaced-apart first end portions, and which is to overlie one side of (and thus form a reinforcing strip for) a neighboring second elongated plate-like part constituting a second component of the blank, having a second length less than the first length, and having two second end portions each adjacent one of the first end portions with a terminal section or tip of each first end portion extending beyond the respective second end portion. The improved method comprises the step of folding the terminal sections relative to an elongated region of the first part between such terminal sections along predetermined fold lines extending transversely of the two elongated parts and being spaced apart from each other a distance less than the first length and close to the second length.

The method can further comprise the step of at least partially weakening the first end portion at the fold lines not later than in the course of the folding step. Such weakening can involve forming a row of perforations or slits and/or reducing the thickness of the first part along the fold lines.

The method can further comprise the step of pivoting at least one of the first and second parts relative to the other of these parts along an elongated further fold line extending longitudinally between the two neighboring parts so that the first part at least partially overlies the one side of the second part when the pivoting step is completed. Such pivoting step can take place at least substantially simultaneously with the folding step.

The folding step can comprise advancing the first part of the blank between two folding members which are spaced apart from each other a distance at least approximating the second length, i.e., the length of the second part which is to form the front panel of the lid of a finished hinged-lid packet. The folding members can form part of a stationary mouthpiece which defines a portion of a path for the advancement of the first part of the blank toward, between and beyond the folding members.

The method can further comprise the steps of advancing the blank to a folding station and thereupon pivoting the first part of the blank at the folding station relative to the second part prior to the folding step so that the first part of the blank at least partially overlies the one side of the second part whereby the terminal sections of the first end portions extend beyond the respective second end portions. Such method can further comprise the aforementioned step of at least partially weakening the first part in the region of the fold lines subsequent to the advancing step and not later than in the course of the folding step. Still further, such method can comprise the step of advancing the blank from the folding station to a further manipulating (converting) station upon completion of the folding step.

In addition to or simultaneously with the folding step, the method can comprise the steps of pivoting one of the first and second parts relative to the other of these parts so that the first part overlies the one side of the second part, and pressing the first part against the one side of the second part.

For example, the just outlined method can comprise the steps of pivoting at least one of the first and second parts relative to the other of these parts so that the first part overlies the one side of the second part, and pressing the first part against the one side of the second part simultaneously with the folding step. If the second part has flaps which are connected to its (second) end portions, the method can further comprise the step of pivoting the flaps relative to the respective second end portions simultaneously with the folding of the terminal sections relative to the aforementioned (intermediate) region of the first part.

Another feature of the invention resides in the provision of an apparatus for manipulating a first elongated plate-like part which constitutes a first component of a blank to be converted into a hinged-lid packet for rod-shaped smokers' products, which has a first length and two spaced-apart first end portions, and which is to overlie one side of a second elongated plate-like part constituting a second component of the blank, pivotably connected with the first part along an elongated first fold line between the two parts, having a second length less than the first length and having two spaced-apart second end portions each adjacent one of the first end portions with a terminal section of each first end portion extending beyond the respective second end portion. The improved apparatus comprises means for advancing a succession of blanks seriatim in a predetermined direction and for locating successive blanks in a predetermined position at a folding station, means for pivoting one of the parts of the blank at the folding station along the first fold line so that the first part at least partially overlies the one side of the second part, and means for folding the terminal sections relative to a region of the first part between the two terminal sections along predetermined second fold lines which extend transversely of the first fold line.

The folding means can comprise a stationary member having portions engaging and folding the terminal sections of the first part during pivoting of the one part relative to the other part of the blank at the folding station. The stationary member can include a mouthpiece and the aforementioned portions of the stationary member are then spaced apart from each other in the longitudinal direction of the elongated parts of a blank at the folding station a distance which is less than the first length and can approximate the second length. Such apparatus can further comprise suitable means for pressing the first part against the one side of the second part of a blank disposed at a second station which is located downstream of the folding station as seen in the predetermined direction. The pressing means can include a first jaw with a first pressing surface which is engageable with one of the first and second parts of a blank at the second station, a second jaw having a second pressing surface engageable with the other of the first and second parts of the blank at the second station, and means for moving at least one of the jaws relative to the other jaw to thereby press the first and second parts of the blank at the second station against each other and against the respective pressing surfaces about the first fold line of such blank. At least one of the jaws can be located at a level above the other jaw.

Furthermore, at least one of the jaws can be provided with additional surfaces which flank and are inclined relative to the respective pressing surface and serve to pivot the terminal sections of the first part of a blank at the second station along the second fold lines relative to the second part and relative to the aforementioned region of the first part between the two terminal sections (i.e., between the second fold lines) in response to movement of the at least one jaw relative to the other jaw to press the parts of the blank at the second station against each other.

The advancing means can comprise at least one conveyor which is arranged to advance the blanks of the succession of blanks seriatim in the predetermined direction sideways first to the folding station and thereupon to the second station in such orientation that the parts of the blanks extend in the predetermined direction.

The advancing and/or folding means can form part of a cigarette packing machine.

The folding means can comprise or constitute a means for pressing the overlying parts of a blank at the folding station against each other, i.e., the second station is optional or can be utilized for other treatment or treatments of successive blanks.

The novel features which are considered as characteristic of the invention are set forth in particular in the appended claims. The improved apparatus itself, however, both as to its construction and the modes of assembling and operating the same, together with numerous additional important features and attributes thereof, will be best understood upon perusal of the following detailed description of certain presently preferred specific embodiments with reference to the accompanying drawings.

DESCRIPTION OF PREFERRED EMBODIMENTS

Figure 2:
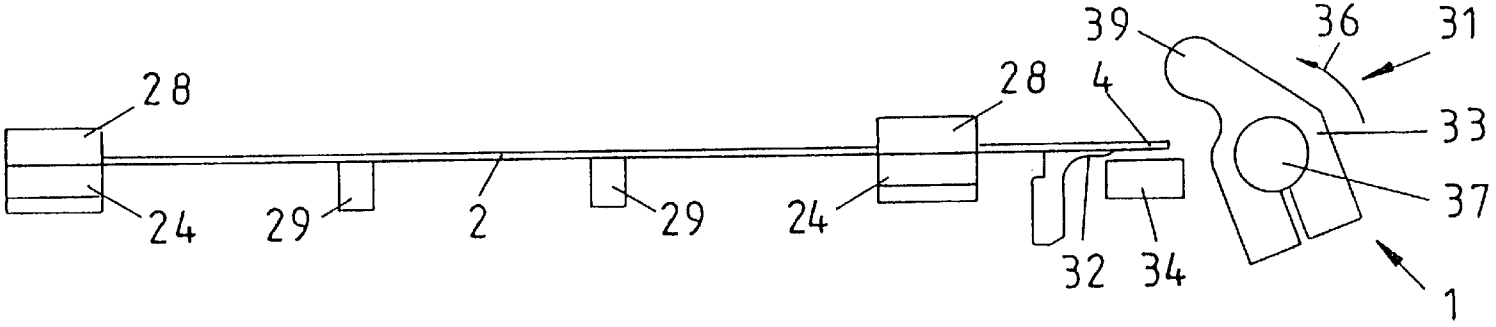
FIG. 2 is a side elevational view of the structure which is shown in FIG. 1, substantially as seen in the direction of arrow II in FIG. 1.
Figure 1:
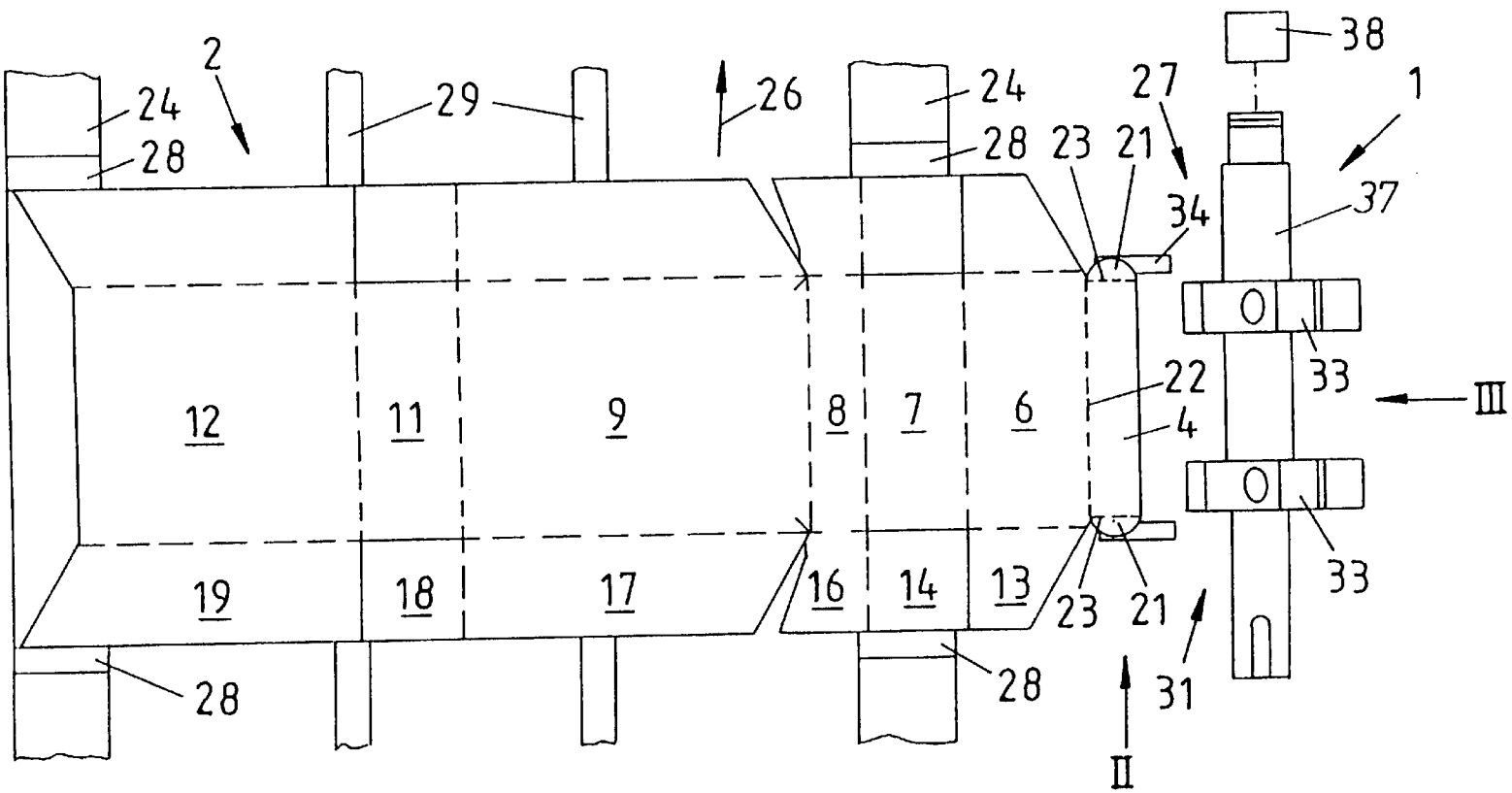
FIG. 1 is a plan view of a blank and of certain parts of the improved blank converting or manipulating apparatus at a folding station for certain parts which are to form the front panel of a lid in a hinged-lid packet.
Figure 3:
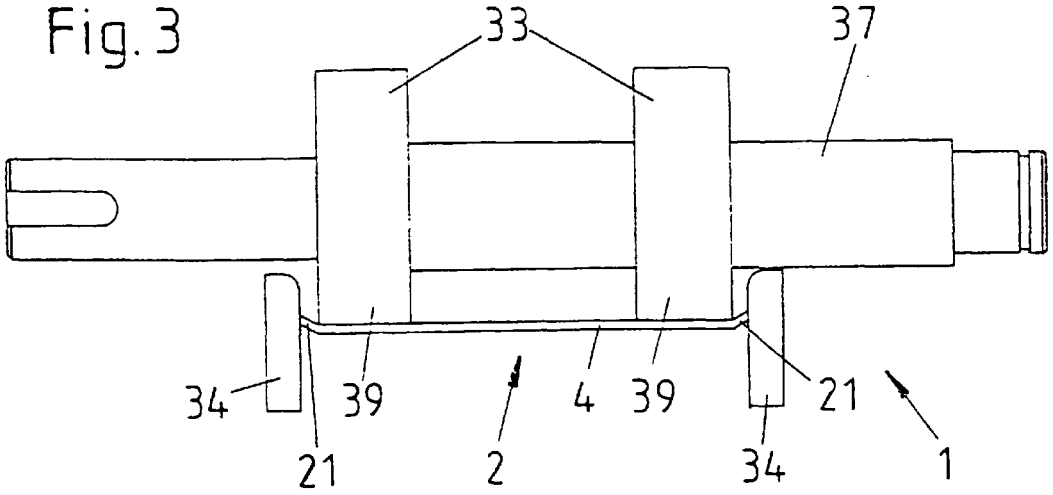
FIG. 3 is an end elevational view substantially as seen in the direction of arrow III in FIG. 1, the folding mechanism of the apparatus being shown in the process of folding a first part relative to a second part of the blank at the folding station and of simultaneously folding the terminal sections of the first part relative to the central region of such part.
Figure 6:
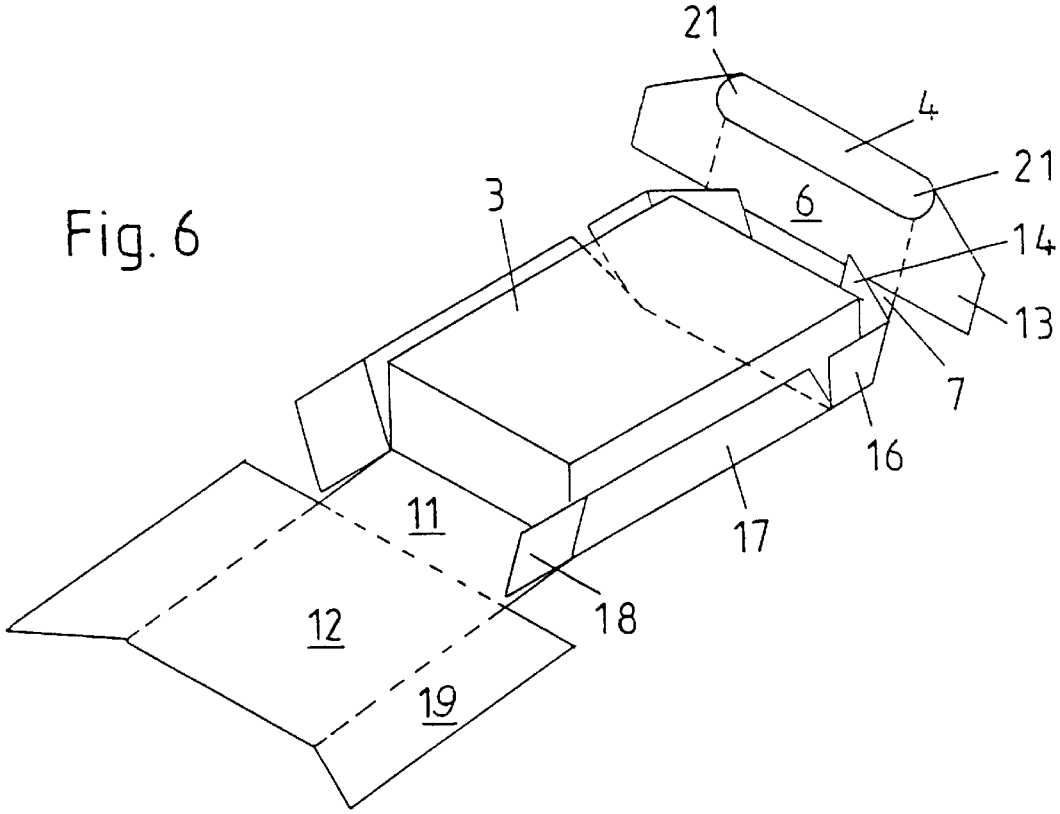
FIG. 6 is a perspective view of a blank and of a block-shaped commodity during a further stage of conversion of the blank into a hinged-lid packet, e.g., in a cigarette packing machine.
Figure 7:
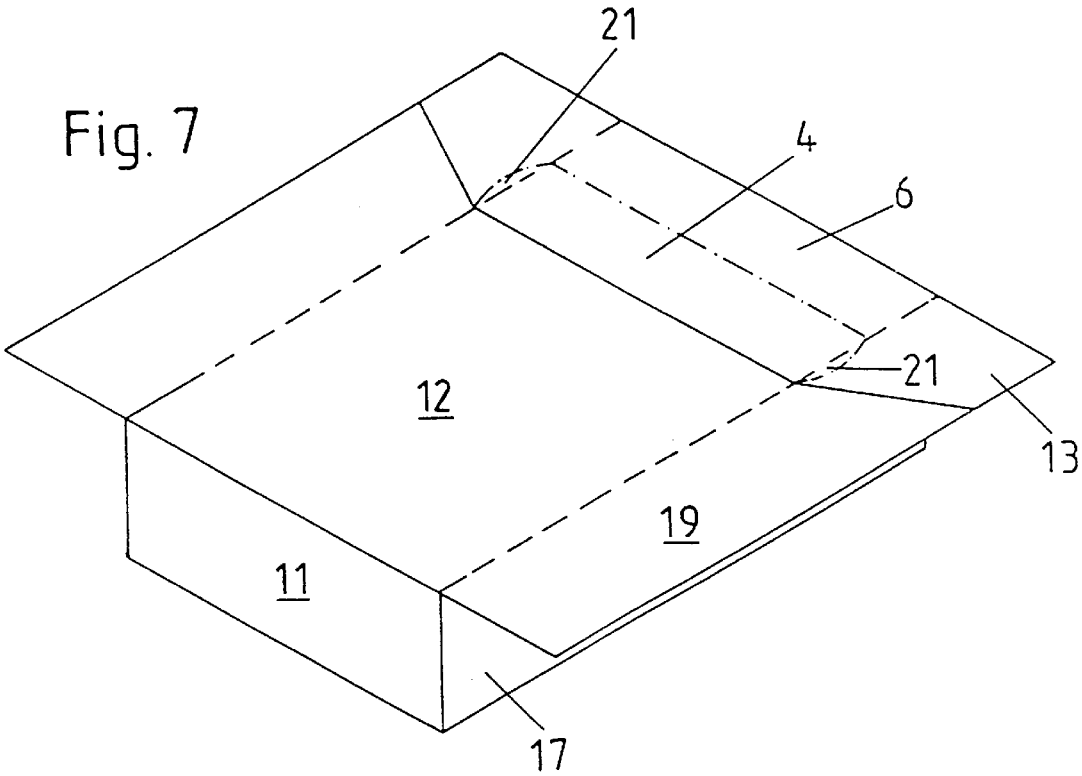
FIG. 7 is a perspective view of a blank during a further stage of conversion into a hinged-lid packet.

FIGS. 1 to 3 show schematically several relevant component parts of an apparatus 1 which can be utilized to convert or manipulate certain parts (4 and 6) of successive lightweight cardboard blanks 2 in order to ultimately convert such blanks into so-called hinged-lid packets each of which contains a block-shaped body 3 (FIG. 6) including an array or group of say twenty plain or filter cigarettes or other rod-shaped smokers' products in an envelope of tinfoil, plastic foil or the like. Partly finished packets are shown in FIGS. 6 and 7.

As can be seen in FIG. 1, an originally flat blank 2 comprises a first elongated flat plate-like part 4 and a second elongated plate-like part 6 which latter is adjacent to and pivotable relative to the apart 4 (and/or vice versa). These parts are connected with and pivotable relative to each other along an elongated fold line 22 which may but need not be weakened in order to enable the apparatus 1 to pivot the part 4 relative to the part 6 (and/or vice versa) so that the part 4 ultimately constitutes a reinforcing strip overlying the inner side of the front panel (part 6) of the lid of a finished hinged-lid packet.

The flat elongated part 6 is adjacent and is pivotable relative to a parallel flat elongated part 7 which constitutes the top panel of the finished lid, and the part 7 is adjacent and parallel to a flat elongated part 8 which ultimately constitutes the rear panel of the lid and can be pivoted relative to a part 9; the latter is convertible into the rear wall of the major portion of the hinged-lid packet. The part 9 is adjacent and pivotable relative to an elongated narrow part 11 which is to constitute the bottom wall of the major portion of the finished packet, and the part 11 is adjacent and pivotable relative to a part 12 which is to constitute the front panel of the finished packet and is adjacent the fold line between the front panel (formerly part 6 of the blank 2) and the reinforcing strip (formerly part 4 of the blank) when the lid of the finished packet is maintained in the closed position in which the part 8 (the rear panel of the lid) is at least substantially coplanar with the rear wall (originally the panel 9) of the major portion of the finished packet.

The end portions of the elongated part 6 are of one piece with flaps 13 forming part of the lateral panels of the finished lid and overlying the flaps 16 at the ends of the part 8 when the lid is finished. The flaps 16 are of one piece with flaps 14 which underlie the top panel (part 7) of the finished lid. The flaps 13 overlie and are bonded to the flaps 16 when the conversion of the parts 4, 6, 7, 8 and flaps 13, 14, 16 into a lid is completed.

The part 9 is flanked by flaps 17, the part 11 is flanked by (but not directly connected with) flaps 18, and the part 12 is flanked by flaps 19 of the blank 2. When the conversion of the parts 9, 11, 12 and flaps 17, 18, 19 into the major portion of the hinged-lid packet is completed, the flaps 18 (which are directly connected to the flaps 17) are located at the inner side of the bottom wall (part 11) and the flaps 19 overlie and are bonded to the neighboring flaps 17.

The broken lines (such as 22, 23 and several unnumbered broken lines) denote prefabricated fold lines between neighboring parts and/or parts and flaps and/or flaps of the blank 2. Solid lines indicate actual cuts between neighboring flaps (such as, for example, the flaps 13, 14 and 18, 19). Thus, the parts and/or flaps (such as 4, 6 or 6, 7 or 7, 8 or 8, 9 or 9, 11 or 11, 12 or 14, 16 or 17, 18) which are joined by fold lines can only pivot relative to each other. On the other hand, the flaps which are bodily separated from each other by cuts (namely those between the flaps 13, 14 and 18, 19) can pivot and/or otherwise move relative to each other.

As can be seen, for example, in FIG. 1, the width of the part 6 exceeds the width of the part 4 so that, when the part 4 is folded against the inner side of the part 6 (see, for example, FIG. 6), the part 4 (reinforcing strip) overlies only a certain portion of the part 6 (front panel of the finished lid). On the other hand, the overall length of the part 4 (inclusive of its rounded (such as substantially semicircular) terminal sections 21) exceeds the length of the part 6 (between the flaps 13). Thus, and in the absence of any undertaking to the contrary, the terminal sections 21 would overlie the adjacent portions of the respective flaps 13 upon completed folding of the part 4 through 180° about the fold line 22 between the parts 4 and 6, and folding of the terminal portions 21 during further stages of conversion of the parts 4, 6, 7, 8 and flaps 13, 14, 16 would have to take place jointly with the flaps 13 which could affect the appearance of the finished lid.

In the absence of the terminal sections 21, the part 4 of a conventional blank was folded against the inner side of the part 6 and was bonded thereto by a film of a suitable adhesive. In accordance with certain other prior proposals, the terminal sections were provided on the part 4 and, therefore, the latter was not bonded to the inner side of the part 6 because, when the conversion of the relevant portion of a blank into the lid of a hinged-lid packet was completed, the terminal sections were folded jointly with the flaps 13 and were in such firm frictional engagement with the flaps 13 that the pivoted part 4 (reinforcing strip) continued to abut the inner side of the part 6 (front panel) even though the parts 4, 6 were not glued or otherwise bonded to each other.

FIG. 6 shows the part 4 subsequent to a pivoting through 180° against the inner side of the part 6. The terminal sections 21 overlie the neighboring flaps 13 and can be maintained in permanent frictional engagement with such flaps when the flaps 17 are pivoted relative to the part 6 through 90° to overlie the flaps 16 of a finished lid.

A drawback of such conventional proposals is that the pivoted terminal sections 21 are bound to deform the adjacent flaps 13 so that portions of the finished lateral panels of the lid (each such lateral panel includes a flap 16, a flap 13 which overlies the flap 16, a film of adhesive between the flaps 13, 16, and a terminal section 21 between the flaps 13, 16) bulge outwardly to detract from the appearance of the lateral panels, of the finished lid, and of the entire hinged-lid packet of such conventional design.

The method and apparatus of the present invention provide the possibility of properly pivoting the terminal sections 21 of the part 4 relative to the (central) region of the part 4 between the terminal sections 21 without affecting the appearance of the lid and without affecting (or unduly affecting) the mechanical strength of the lid even though the pivoted part (4) need not be bonded to the inner side of the part 6. Thus, the reinforcing strip (formerly part 4) can continue to abut the inner side of the front panel (formerly part 6) upon repeated opening and closing of the finished hinged-lid packet.

In accordance with the present invention, the aforediscussed drawbacks of prior proposals and prior hinged-lid packets are overcome by the expedient of providing the part 4 with a pair of spaced-apart fold lines 23 which are parallel to each other and normal to the fold line 22 between the parts 4 and 6. The fold lines 23 are provided between the terminal sections 21 and that region of the part 4 which is of one piece with the part 6 (along the fold line 22). The distance between the fold lines 23 matches or is only slightly less than the length of the part 6 (between the flaps 13) and is evidently less than the overall length of the part 4 inclusive of the terminal sections 21.

The apparatus 1 is designed to automatically prefold the terminal sections 21 relative to the central region of the part 4 along the fold lines 23, preferably during pivoting or folding of the part 4 toward the inner side of the part 6. The thus prefolded terminal sections 21 can be brought into pronounced frictional (mechanical) engagement with the flaps 16 and/or 13 (i.e., with the lateral panels of the lid) not later than when the conversion of the parts 4, 6, 7, 8 and flaps 13, 14, 16 into a lid is completed. However, the bias of the initially prefolded and thereupon finally folded terminal sections 21 is not sufficiently pronounced to cause a highly undesirable outward bulging of the lateral panels of the finished lid.

It is normally preferred to weaken at least a portion of the part 4 along each of the fold lines 23, e.g., by rows of perforations, by rows of slits and/or by compressing the blank 2 along the fold lines 23 so that the thickness of the material of the blank 2 along the fold lines 23 is reduced accordingly. The material of the blank 2 can also be weakened along the fold line 22 between the parts 4 and 6 to render the pivoting of the part 4 against the inner side of the part 6 even more predictable. The same holds true for all other fold lines, e.g., those between the parts 6 and 7, 7 and 8, etc.

Those components of the apparatus 1 which are shown in FIGS. 1 to 3 include a composite conveyor comprising two spaced-apart parallel endless conveyors 24 which are driven to intermittently advance a series of successive blanks 2 sideways (namely so that the elongated parts 4, 6, 7, 8, 11 of each blank 2 extend in the direction of the arrow 26 which indicates the direction of intermittent movement of the conveyors 24. The illustrated conveyors 24 are toothed belts. Each blank 2 comes to a halt at a folding station 27 where the part 4 is pivoted through a certain angle (less than 180°) so that it does not immediately abut the inner side (underside) of the part 6. In the apparatus which is shown in FIGS. 1 to 9, actual pivoting of the part 4 against the adjacent side of the part 6 takes place at a station other than the folding station 27.

The conveyors 24 are provided with spaced-apart positioning and entraining elements 28 which ensure that each of a short or long series of successive blanks 2 is reliably maintained in a predetermined position upon arrival and during temporary stay at the folding station 27. The means for guiding and locating the blanks 2 during advancement with the conveyors 24, or at least at the folding station 27, comprises elongated guide rails 29 extending in the direction indicated by the arrow 26. The combined advancing and locating means including the conveyors 24 and the rails 29 is or can be similar to the advancing means disclosed in the aforementioned U.S. Pat. No. 4,154,438 to Seragnoli.

The means 31 for folding the part 4 of the blank 2 at the folding station 27 includes an elongated stationary folding member 32 which underlies at least a portion of the part 6 along the fold line 22, and a plurality of (e.g., two) preferably identical mobile (such as pivotable or indexible) folding members 33 which are spaced apart from each other, as seen in the direction of the arrow 26.

The means for pivoting the two terminal sections 21 relative to the remaining (central) region of the part 4 at the folding station 27 (in response to pivoting of the part 4 relative to the part 6, i.e., along the hinge represented or constituted by the fold line 22) includes a stationary mouthpiece having two spaced-apart folding members 34. The distance between the stationary folding members 34 at least matches the length of the part 6 between the flaps 13 and is less than the overall length of the part 4 prior to pivoting of the terminal sections 21 along the respective fold lines 23. The part 4 is caused to advance along a path extending through the stationary mouthpiece (i.e., between the folding members 34) during pivoting by the mobile folding members 33 of the folding means 31.

The mobile folding members 33 are mounted on a shaft 37 which is preferably intermittently driven by a suitable prime mover 38 (e.g., an electric motor) so that the projections 39 of the folding members 33 move along arcuate paths in the direction indicated by an arrow 36 to thereby pivot the part 4 along the fold line 22, i.e., in a clockwise direction (as viewed in FIG. 2) and relative to the stationary folding member 32.

FIG. 1 shows that the mobile folding members 33 are adjacent the stationary folding members 34 of the aforementioned mouthpiece, i.e., of the means for pivoting the terminal sections 21 relative to the central region of the part 4, so that the terminal sections 21 are pivoted relative to the central region of the part 4 while the latter is being pivoted relative to the part 6 from a first position in which the parts 4, 6 are or can be at least substantially coplanar to a second (intermediate) position (shown in FIG. 4) in which the parts 4, 6 make an oblique angle. Further pivoting of the part 4 relative to the part 6 is then taken over by one or more additional mobile folding members 41 (FIGS. 4 and 5) which are turnable or pivotable in a counterclockwise direction about the axis of a shaft 42. The latter is parallel to the shaft 37 and can receive motion from the shaft 37 (i.e., from the prime mover 38) or from a discrete prime mover. The axes of the shafts 37, 42 are parallel to the elongated stationary folding member 32 for the part 4 of the blank 2 at the folding station 27.

Figure 5:
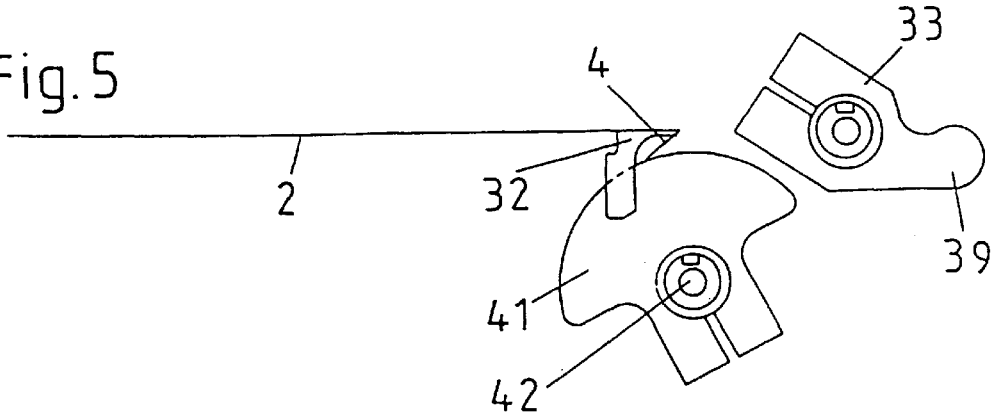
FIG. 5 shows the structure of FIG. 4 but with the parts of the folding means in different positions which they assume upon completion of manipulation of certain parts of a blank at the folding station.

The extent of pivoting of the part 4 by the second mobile folding member(s) 41 is shown in FIG. 5. Thus, the part 4 is moved to a position close to but still spaced apart from the underside of the part 6.

Figure 4:
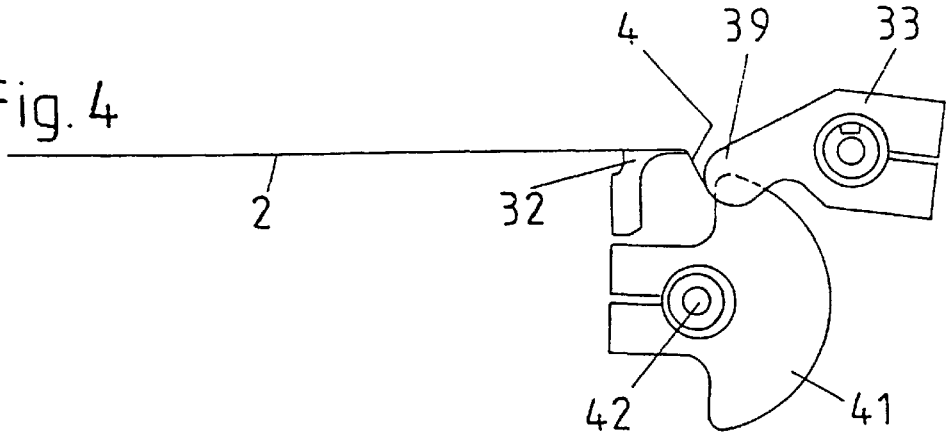
FIG. 4 is a fragmentary side elevational view similar to that of FIG. 2 but showing the parts of the folding mechanism at the folding station in different positions.

The mode of operation of the folding means 31 for the part 4 and of the means (34) for pivoting the terminal sections 21 along the respective fold lines 23 is shown in FIGS. 2 to 5 and is as follows:

When a fresh blank 2 comes to a temporary halt at the folding station 27, the prime mover 38 turns the shaft 37 in the direction of the arrow 36 so that the projections. 39 of the folding members 33 move along the stationary folding member 32 in order to pivot the part 4 along the fold line 22 to the angular position of FIG. 4. This suffices to at least partially fold the terminal sections 21 along the respective fold lines 23 toward but preferably not immediately all the way to positions at right angles to the central region of the part 4. FIG. 3 shows that the pivoting of the mobile folding members 33 along the stationary folding members of the mouthpiece entails a pivoting of the terminal sections 21 through angles of approximately 45°.

Further pivoting of the part 4 along the fold line 22 is then taken over by the second mobile folding member or members 41 (compare FIGS. 4 and 5) which can be set up to turn the part 4 through an angle of approximately 90° so that the upper side of the twice pivoted part 4 is close to but still spaced apart from the adjacent underside of the part 6.

Figure 9:
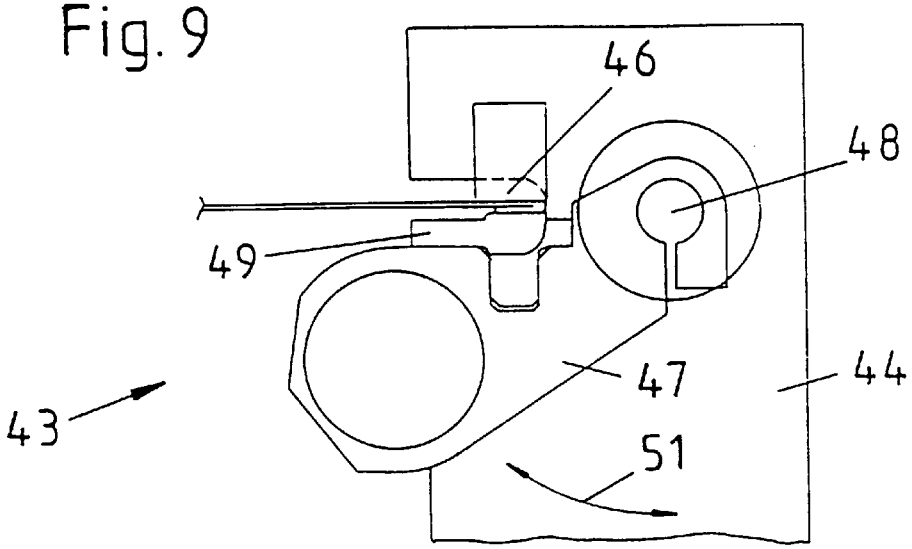
FIG. 9 shows the structure of FIG. 8 but upon completion of the treatment of a blank at the second station.

The conveyors 24 are thereupon set in motion to advance the blank 2 from the folding station 27 to a second folding station 43 (FIGS. 8 and 9) where the blank comes to a halt in a predetermined position relative to a composite pressing device or press 44 serving to press the twice pivoted part 4 (namely first by the projections 39 and thereupon by the mobile member or members 41) all the way against the underside of the adjacent portion of the part 6 (see FIG. 9).

The pressing device 44 comprises a stationary upper jaw 46 and a mobile lower jaw 49. The jaw 49 is mounted on or is of one piece with a carrier 47 which is pivotable (rockable) back and forth (see the arrow 51) about the axis of a horizontal shaft 48. The prime mover which transmits motion to the carrier 47 (with or relative to the shaft 48) is not shown in the drawings; such prime mover can comprise a reversible electric motor, a double acting hydraulic or pneumatic cylinder and piston unit, or the like.

Figure 8:
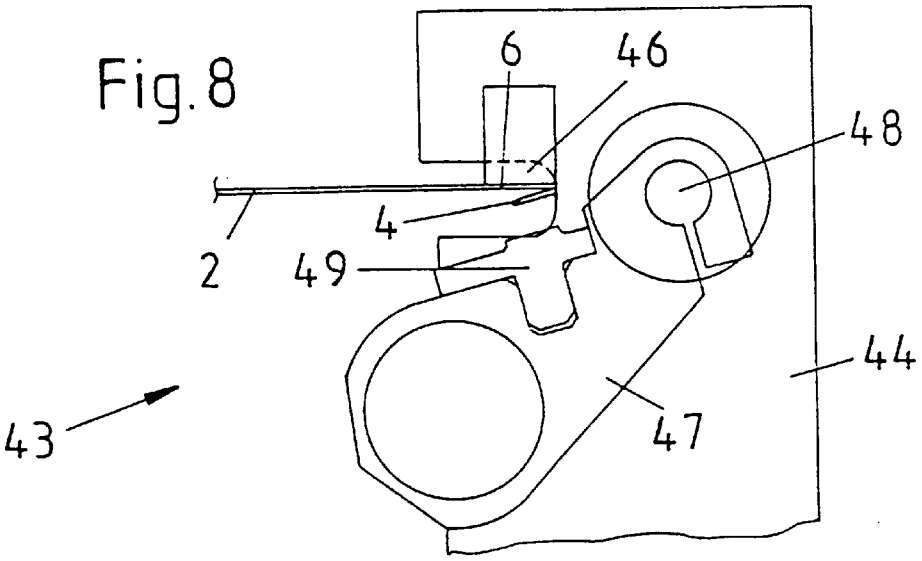
FIG. 8 is a side elevational view of a press for the treatment of certain parts of blanks at a second station downstream of the folding station of FIGS. 1 to 5.

FIG. 8 shows the pressing device 44 in its inoperative (open) condition, i.e., the jaw 49 is spaced apart from the jaw 46 so that the parts 4, 6 can enter the space between the two jaws. The jaw 49 is thereupon pivoted in a clockwise direction so that its pressing surface (upper surface) urges the part 4 against the underside of the part 6 and the upper side of the part 6 bears against the pressing surface (underside) of the stationary jaw 46. This completes the conversion of the parts 4, 6 into a composite front panel of a lid. Such composite front panel is constituted by the part 6 and the part 4 which latter constitutes a reinforcing strip for the part 6. The reinforcing strip abuts that part of the inner side of the part 6 which is adjacent the fold line 22.

The next step involves the advancement of the partly converted blank 2 from the second station 43 to a next-following station (not shown), e.g., in a cigarette packing machine (not shown) wherein the conversion of the blank into a finished hinged-lid packet is completed in the customary way. The lid of the finished packet comprises the parts 4, 6, 7 and 8, the pairs of flaps 13, 14 and 16, and the pair of terminal sections 21 which are then confined between the flaps 13, 16 of the respective lateral walls of the lid. The main portion of the finished packet comprises the parts 9, 11 and 12, and the pairs of flaps 17, 18 and 19.

The packing machine can include a so-called parceller, e.g., a parceller known as G 90 which is distributed by the assignee of the present application.

The aforementioned pressing surfaces of the jaws 46, 49 which are shown in FIGS. 8 and 9 are flat; they can cause the upper side of the part 4 to lie flush against the underside of the part 6. This is the customary design of an apparatus for converting blanks of lightweight cardboard or the like into hinged-lid packets.

Figure 10:
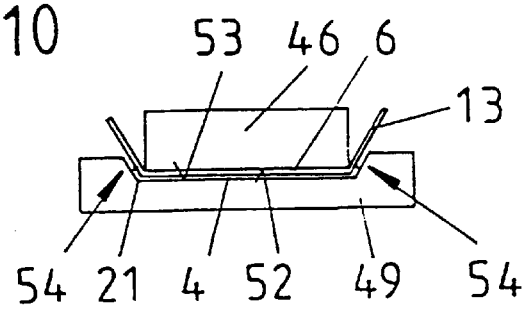
FIG. 10 is an end elevational view of a portion of a modified apparatus which can dispense with the parts of the apparatus at the folding station of FIGS. 1 to 5.

FIG. 10 shows a portion of a modified apparatus wherein the pressing surface 53 of the pivotable jaw 49 is flanked by two upwardly inclined or sloping additional surfaces or faces 54 serving to fold the flaps 13 relative to the part 6 and to simultaneously fold the terminal sections 21 relative to the major (central) region of the part 4. The pivoting of the terminal sections 21 by the respective additional surfaces 54 can take place through angles of approximately 45° (i.e., at least close to that pivoting which is carried out by the stationary folding members 34 shown in FIG. 3). Additional pivoting of the terminal sections 21 relative to the main or central region of the part 4 can take place simultaneously with additional pivoting of the flaps 13 to convert the flaps 13 and the neighboring flaps 16 into the lateral panels of a finished lid. However, such preliminary pivoting (as shown in FIGS. 3 and 10) of the terminal sections 21 along the respective weakened fold lines 23 suffices to ensure that the fully pivoted or folded sections 21 cannot affect the appearance of the finished lateral panels of the lid.

The stationary jaw 46 of the modified pressing device which is shown in FIG. 10 can be provided with additional surfaces (not shown) which are complementary to the additional surfaces 54 of the mobile lower jaw 49.

Pivoting of the flaps 13 by the additional surfaces 54 of the jaw 49 takes place along fold lines (shown in FIGS. 1, 6 and 7 by broken lines) which can be weakened in the same way as the fold line 22 and/or the fold lines 23. FIG. 1 shows that the distance between the flaps 13 slightly exceeds the distance between the fold lines 23; this ensures that the part 4 can lie flush against the inner side of the part 6 and further reduces the likelihood that the pivoted terminal sections 21 would adversely affect the appearance of the lateral panels of the finished lid.

An advantage of the modified apparatus which includes the structure shown in FIG. 10 is that the components at the folding station 27 can be omitted or, at the very least, the stationary mouthpiece including the folding members 34 can be dispensed with. However, it is clear that the structure of FIG. 10 can be utilized jointly with the structure of FIGS. 1 to 5, i.e., that the pivoting of the terminal sections 21 can take place in several stages, first at the folding station 27 (e.g., through a first angle) and thereupon at the second station 43 (e.g., again through the first angle or through a different second angle).

The next stages of conversion of a blank 2 into a hinged-lid packet take place in a manner as shown in FIGS. 6 and 7, namely by folding the various panels and flaps of the blank around a parallelepiped (block-shaped) group or array 3 of (for example twenty) parallel plain or filter cigarettes, cigarillos or the like while such articles are confined in an envelope or wrapper of tinfoil, another metallic foil and/or a plastic foil or the like. Such further manipulation of partially converted blanks 2 normally takes place in a cigarette packing machine.

FIG. 6 shows a stage of conversion of a blank 2 into a hinged-lid packet (i.e., around a block-shaped group or array 3) which can take place in a packing machine for plain or filter cigarettes or other rod-shaped articles of the tobacco processing industry. Thus, the underside of the array 3 overlies the part 9, the pairs of flaps 16, 17 and 18 are already pivoted in part relative to the respective parts 8, 9 and 11, the flaps 14 are pivoted relative to the respective flaps 16, and the parts 4, 6 and 7 are pivoted relative to the part 8. The terminal sections 21 still extend beyond the end portions of the part 6 because it is assumed that the initial manipulation of the blank 2 of FIG. 6 took place in an apparatus which does not employ the stationary mouthpiece including the folding members 34, i.e., the terminal sections 21 are pivoted jointly with the respective flaps 13 by the additional surfaces 54 shown in FIG. 10.

FIG. 7 shows a further stage of conversion of a blank 2 into a hinged-lid packet. Thus, the parts 6 and 12 already overlie the adjacent side of the array 3 (not visible in FIG. 7), the wall 11 also overlies the adjacent side of the array, and the flaps 17 overlie the adjacent side of the array. The undersides of the pairs of flaps 13, 19 (and/or the exposed sides of the pairs of flaps 16, 19) are coated with a suitable adhesive so that they can be bonded to the adjacent flaps 13, 19. The flaps 18 are overlapped by the part 11, and the flaps 14 are overlapped by the part 7. The terminal sections 21 are ready to be folded simultaneously with the respective flaps 13, i.e., against the outer sides of the respective flaps 16. However, the terminal sections 21 need not be bonded to the flaps 13 and/or 16; nevertheless, they can reliably hold the part 4 in requisite abutment with the inner side of the part 6 even though the parts 4, 6 are not and need not be glued or otherwise bonded to each other.

An important advantage of the improved method and apparatus is their simplicity. Thus, the part 4 need not be bonded to the part 6 but nevertheless remains in an optimum position by resorting to the expedient of providing the fold lines 23 and by effecting an at least partial folding of the terminal sections 21 relative to the central or median region of the part 4 simultaneously with or prior to pivoting of the part 4 along the fold line 22, i.e., relative to the part 6. The result is that the lateral panels (13+16) of the finished lid are not deformed and that the pivoted part 4 remains in an optimum position even though it is not glued to the inner side of the pat 6.

Though it is possible to pivot the terminal sections 21 (by the members 34 of the stationary mouthpiece) prior or subsequent to pivoting of the part 4 (by the pivoting means 31), a pivoting of the terminal sections relative to each other simultaneously with a pivoting of the part 4 relative to the part 6 is preferred at this time because the conversion of a blank into a hinged-lid packet (or a partial conversion of certain parts and flaps of the blank 2 into a lid) takes up a shorter interval of time.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above outlined contribution to the art of making hinged-lid packets for rod-shaped smokers' products and, therefore, such adaptations should and are intended to be comprehended within the meaning and range of equivalence of the appended claims.

What is claimed is:

1. An apparatus for manipulating a blank for conversion into a hinged lid packet for rod-shaped smokers' products, the blank being substantially flat and having a first side and a second side opposite to the first side, the blank further including: a first part and two spaced-apart terminal portions, the terminal portions each pivotally connected to the first part along a respective first fold line and the first part and terminal portions combined having a first length; a second part having a second length and pivotably connected with the first part along a second fold line between the first part and the second part, the second fold line approximately perpendicular to the first fold lines, and the second part pivotably connected to two spaced-apart end portions each adjacent one of the terminal portions; and the apparatus for manipulating the blank comprising:

a folding station;

means for advancing a succession of blanks seriatim in a direction of motion and for locating successive blanks in a predetermined position at the folding station;

means for folding the first part of a blank at the folding station along said second fold line so that the first part at least partially overlies the second part; and means for pivoting the terminal portions relative to the first part along the respective first fold lines, wherein said pivoting means comprises a stationary member having portions engaging and folding said terminal portions during pivoting of said first part relative to the second part of the blank at said folding station.

2. The apparatus of claim 1 in combination with the blank, wherein said stationary member includes a mouthpiece and said portions of said stationary member are spaced apart from each other in the direction of motion a distance close to said second length but less than said first length.

3. The apparatus of claim 1, further comprising means for pressing the first part against one of the first side and the second side of the second part of the blank, the means for pressing at a second station located downstream of said folding station in the direction of motion.

4. The apparatus of claim 3, wherein said means for pressing includes a first jaw with a first pressing surface engageable with one of said first and second parts of the blank at said second station, a second jaw having a second pressing surface engageable with the other of the first and second parts of the blank at said second station, and means for moving at least one of said jaws relative to the other of said jaws to thereby press the first and second parts of the blank against each other and against the respective pressing surfaces.

5. The apparatus of claim 4, wherein one of said jaws is located at a level above the other of said jaws.

6. The apparatus of claim 4, wherein at least one of said jaws has additional surfaces flanking and inclined relative to the respective pressing surface and arranged to pivot the terminal portions along said first fold lines relative to the second part and relative to the first part in response to movement of said at least one jaw relative to the other jaw to press the parts of the blank at said second station against each other.

7. The apparatus of claim 3, wherein said advancing means includes at least one conveyor arranged to advance a plurality of the blanks in succession in said direction of motion sideways first to said folding station and thereupon to said second station in such orientation that said parts of the blanks extend in said predetermined direction.

8. The apparatus of claim 1, wherein said apparatus forms part of a cigarette packing machine.

9. The apparatus of claim 1, wherein said folding means includes means for pressing the first part and the second part of the blank against each other.

10. The apparatus according to claim 1, wherein the means for folding the first part of a blank comprises:

a folding ledge, the folding ledge including a folding edge;

a first rotatable folding member that engages and pivots the first part at the second fold line and along the folding edge of the folding ledge and establishes a first intermediate position; and a second rotatable folding member synchronized with the first rotatable folding member, which pushes the first part from the first intermediate position toward the second part.

11. The apparatus according to claim 10, wherein the folding ledge is stationary.

12. The apparatus according to claim 10, wherein the first rotatable folding member comprises a shaft and two identical rotating bodies that are arranged on the shaft and rotate in a direction.

13. The apparatus according to claim 12, wherein each of the rotating bodies of the folding member is provided with a projection, which cooperates with the folding ledge and acts upon the first part.

14. The apparatus according to claim 12, wherein the shaft for the first rotatable folding member extends parallel to the folding edge of the folding ledge.

15. The apparatus according to claim 12 wherein the second rotatable folding member comprises a second shaft and at least one rotating body arranged on the second shaft so as to rotate between the rotating bodies of the first rotatable folding member.

16. The apparatus according to claim 10, wherein the first folding member is arranged such that it folds the first part in a downward direction to the first intermediate position and the second folding member is arranged such that it then folds the first part in an upward direction toward the second part.

17. The apparatus of claim 1, wherein said stationary member of the pivoting means includes a mouthpiece and said portions of said stationary member of the pivoting means are spaced apart from each other in the direction of motion a distance such that when the first part of the blank is folded by the folding means the first part passes between the stationary members of the pivoting means and the terminal portions strike the stationary members and are pivoted thereby along the respective first fold lines.

18. An apparatus for manipulating a blank for conversion into a hinged lid packet for rod-shaped smokers' products, the blank being substantially flat and including a first part and a second part pivotably connected with the first part along a fold line between the first part and the second part; and wherein the apparatus for manipulating the blank comprises:

a folding station;

means for advancing a succession of blanks seriatim in a direction of motion and for locating successive blanks in a predetermined position at the folding station; and means for folding the first part of a blank at the folding station along said fold line so that the first part at least partially overlies the second part, the means for folding including:

an elongated folding member, the elongated folding member including a folding edge;

a first rotatable folding member that engages and pivots the first part at the fold line and along the folding edge of the enlongated folding member and establishes a first intermediate position; and a second rotatable folding member synchronized with the first rotatable folding member, which pushes the first part from the first intermediate position toward the second part.

19. The apparatus according to claim 18, wherein the elongated folding member is stationary.

20. The apparatus according to claim 19, wherein the first rotatable folding member comprises a shaft and two identical rotating bodies that are arranged on the shaft and rotate in a direction.

21. The apparatus according to claim 20, wherein each of the rotating bodies of the folding member includes a projection which pushes on the first part of the blank causing the blank to fold at the fold line and to fold over the folding edge of the elongated folding member.

22. The apparatus according to claim 20, wherein the shaft for the first rotatable folding member extends parallel to the folding edge of the elongated folding member.

23. The apparatus according to claim 20 wherein the second rotatable folding member comprises a second shaft and at least one rotating body arranged on the second shaft so as to rotate between the rotating bodies of the first rotatable folding member.

24. The apparatus according to claim 18, wherein the first folding member is arranged such that it folds the first part in a downward direction to the first intermediate position and the second folding member is arranged such that it then folds the first part in an upward direction toward the second part.

* * * * *